US007900386B2

(12) United States Patent
Zheng

(10) Patent No.: US 7,900,386 B2
(45) Date of Patent: Mar. 8, 2011

(54) COLLAPSIBLE STRUCTURES SUPPORTED ON A POLE

(75) Inventor: Yu Zheng, Covina, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 12/315,065

(22) Filed: Nov. 26, 2008

(65) Prior Publication Data

US 2009/0078381 A1 Mar. 26, 2009

Related U.S. Application Data

(63) Continuation of application No. 11/300,536, filed on Dec. 14, 2005, now abandoned, which is a continuation of application No. 10/881,415, filed on Jun. 29, 2004, now abandoned, which is a continuation of application No. 10/453,962, filed on Jun. 4, 2003, now Pat. No. 6,758,003, which is a continuation of application No. 09/912,896, filed on Jul. 25, 2001, now Pat. No. 6,581,313, which is a continuation of application No. 09/241,295, filed on Feb. 1, 1999, now Pat. No. 6,266,904.

(51) Int. Cl.
*G09F 17/00* (2006.01)

(52) U.S. Cl. ..... 40/603

(58) Field of Classification Search ..... 160/351; 135/19.5, 99, 98, 114; 108/149, 159, 50.12, 108/158.11, 153.1, 157.1, 150; 40/604, 603
See application file for complete search history.

(56) References Cited

U.S. PATENT DOCUMENTS

| | | | | |
|---|---|---|---|---|
| 1,215,139 | A | | 1/1917 | Dalbey |
| 1,579,034 | A | | 3/1926 | Roberts |
| 2,072,573 | A | | 3/1937 | Vigliotti |
| 2,670,855 | A | * | 3/1954 | Pierie ..... 211/197 |
| 2,688,303 | A | | 9/1954 | Leander |
| 3,075,492 | A | | 1/1963 | Winfrey |
| 3,089,268 | A | | 5/1963 | Frey et al. |
| 3,239,957 | A | | 3/1966 | Snediker |
| 3,266,458 | A | | 8/1966 | Ahlquist |
| 3,287,840 | A | | 11/1966 | Keats |
| 3,477,453 | A | * | 11/1969 | Ulisse et al. ..... 135/95 |
| 3,824,725 | A | | 7/1974 | Friedrichsen |
| 4,312,371 | A | | 1/1982 | Koon |
| 4,709,928 | A | | 12/1987 | Willingham |
| 4,815,784 | A | | 3/1989 | Zheng |

(Continued)

FOREIGN PATENT DOCUMENTS

JP 8-57164 3/1996

OTHER PUBLICATIONS

Photographs of Instruction Sheets and Packaging for Japanese Product sold in 1994 (4 photos) LLBL0312-15.

*Primary Examiner* — Joanne Silbermann
(74) *Attorney, Agent, or Firm* — Raymond Sun

(57) ABSTRACT

A collapsible object is provided having a foldable frame member that has a folded and an unfolded orientation, and a material covering portions of the frame member when the frame member is in the unfolded orientation, with the material assuming the unfolded orientation of its associated frame member. A pole coupled to the panel to support the panel.

6 Claims, 10 Drawing Sheets

U.S. PATENT DOCUMENTS 4,825,892 A 5/1989 Norman
5,016,372 A 5/1991 Gold
5,024,262 A 6/1991 Huang
5,024,551 A 6/1991 Hinterholzer
5,038,812 A 8/1991 Norman
5,249,592 A 10/1993 Springer et al.
5,301,705 A 4/1994 Zheng
5,343,887 A 9/1994 Danaher
5,358,440 A 10/1994 Zheng
5,411,046 A 5/1995 Wan
5,443,036 A 8/1995 Amiss et al.
5,579,799 A 12/1996 Zheng
5,611,380 A 3/1997 Landy
5,632,318 A 5/1997 Wang
5,778,915 A 7/1998 Zheng
5,816,954 A 10/1998 Zheng
5,927,793 A 7/1999 McGrath, Jr.
5,941,265 A 8/1999 Zheng
6,003,256 A 12/1999 Leach et al.
6,266,904 B1 * 7/2001 Zheng ..... 40/604
6,502,596 B1 1/2003 Danaher
6,581,313 B1 6/2003 Zheng
6,628,357 B1 9/2003 Maeda et al.
6,758,003 B2 7/2004 Zheng

* cited by examiner

COLLAPSIBLE STRUCTURES SUPPORTED ON A POLE

RELATED APPLICATIONS

The present application is a continuation of Ser. No. 11/300,536, filed Dec. 14, 2005 now abandoned, which is a continuation of Ser. No. 10/881,415, filed Jun. 29, 2004, now abandoned, which is a continuation of Ser. No. 10/453,962, filed Jun. 4, 2003, now U.S. Pat. No. 6,758,003, which is a continuation of Ser. No. 09/912,896, filed Jul. 25, 2001, now U.S. Pat. No. 6,581,313, which is a continuation of Ser. No. 09/241,295, filed Feb. 1, 1999, for "Collapsible Structures Supported On A Pole", now U.S. Pat. No. 6,266,904.

BACKGROUND OF THE INVENTION

1. Field of the Invention

The present invention relates to collapsible structures, and in particular, to collapsible structures that can be supported on a pole.

2. Description of the Prior Art

Collapsible objects have recently become very popular. These objects have one or more panels which may be twisted and folded to reduce the overall size of the structures to facilitate convenient storage and use. As such, these collapsible objects are being enjoyed by many people in many different applications.

One such application is for use as collapsible shelters or play structures. Examples of collapsible shelters or play structures are shown and described in the following Zheng patents: U.S. Pat. Nos. 5,467,794, 5,560,385, 5,722,446, 5,778,915 and 5,816,954.

Another application is for use as collapsible sunshields, such as illustrated in U.S. Pat. No. 4,815,784 (Zheng). These sunshields have two interconnecting panels that span the width of the windscreen.

Yet another application is for use as collapsible flying structures, such as illustrated in U.S. Pat. No. 5,358,440 (Zheng).

SUMMARY OF THE DISCLOSURE

It is an object of the present invention to provide collapsible structures or objects that can be used in new and different applications.

It is another object of the present invention to provide collapsible structures or objects that can be supported by a pole.

It is a further object of the present invention to provide a collapsible umbrella.

It is yet a further object of the present invention to provide a collapsible flag, sign or exhibit medium.

In order to accomplish the objects of the present invention, the collapsible objects according to the present invention have a panel having a foldable frame member that has a folded and an unfolded orientation, and a material covering portions of the frame member when the frame member is in the unfolded orientation, with the material assuming the unfolded orientation of its associated frame member. A pole coupled to the panel to support the panel.

In one embodiment, an attachment mechanism is coupled to an edge of the panel for coupling the panel to the pole.

In another embodiment, an opening is provided in the material of the panel, and the pole is inserted through the opening. A pole retaining sleeve is coupled to the panel and aligned with the opening to receive the pole. At least one support can be provided, with a first end coupled to the pole retaining sleeve and a second end coupled to the panel. The pole retaining sleeve has an opening, and the pole has a through-hole that is adapted to be aligned with the opening of the pole retaining sleeve, with a pin inserted through the opening of the pole retaining sleeve and the through-hole.

In one embodiment of the present invention, the frame member is collapsible to the folded position by twisting and folding to form a plurality of concentric rings and layers of material to substantially reduce the size of the panel in the folded position.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible objects that can be supported by a pole. The principles of the present invention can be applied to provide more convenient use and possible new uses for certain objects that are supported on poles, including but not limited to flags, games, umbrellas and exhibit media.

Figures 1A, 2:
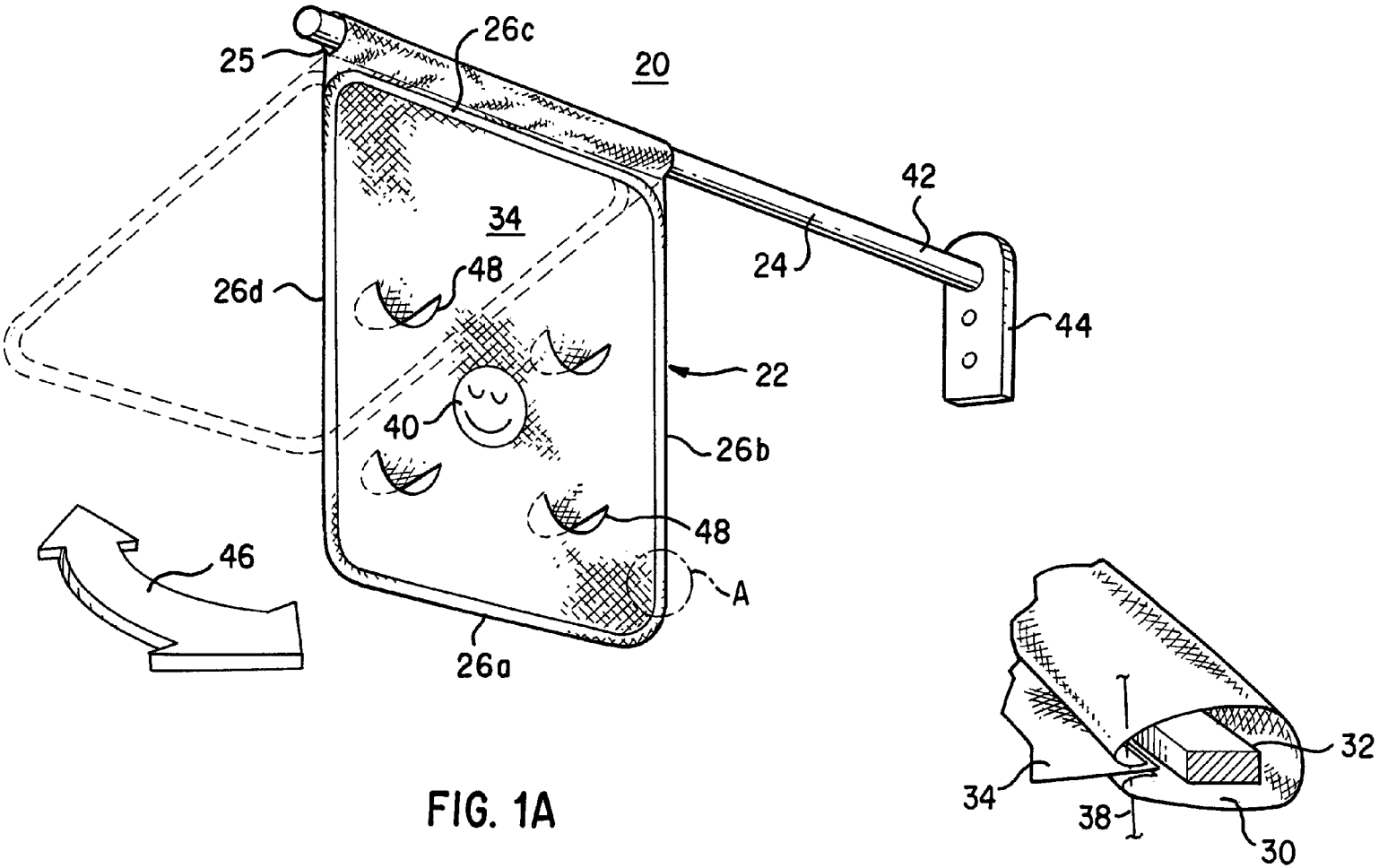
FIG. 1A is a perspective view of a collapsible exhibit medium according to one embodiment of the present invention shown in use in its expanded configuration.
FIG. 2 is a partial cut-away view of the section A of the panel of FIG. 1A illustrating a frame member retained within a sleeve.

FIGS. 1 and 2 illustrate a collapsible object 20 that embodies the underlying principles of the present invention. Referring to FIG. 1, the object 20 can take the form of a flag, although the object 20 may have other uses, as described below. The object 20 has a collapsible panel 22 that is coupled to a pole 24 by any conventional attachment mechanism 25, including but not limited to strings, straps, rope, opposing Velcro™ pads, links and chains. The panel 22 can be coupled to any part of the pole 24, depending on the desired application and usage. The conventional attachment mechanism 25 can even be a sleeve 70 (see FIG. 1A) that is formed by folding a piece of fabric (as this term is defined below) and then stitched (along stitch line 72) to an edge of the panel 22, with the pole 24 retained inside the sleeve 70. One or more ties (such as 74) can be provided at any part of the sleeve 70 or panel 22 to tie the combined panel 22 and sleeve 70 to the pole 24 to secure the panel 22 at the desired position along the pole 24.

The panel 22 can assume any configuration, such as circular, oval, rectangular (as shown), square, trapezoidal, or irregular. As shown in FIG. 1A, the panel 22 has four side edges, a left side edge 26*a*, a bottom side edge 26*b*, a right side edge 26*c*, and a top side edge 26*d*. Referring also to FIG. 2, the panel 22 has a continuous frame retaining sleeve 30 provided along and traversing the four edges of its four sides. A continuous frame member 32 is retained or held within the frame retaining sleeve 30 to support the panel 22.

The continuous frame member 32 of the panel 22 may be provided as one continuous loop, or may be a strip of material connected at both ends to form a continuous loop. The frame member 32 is preferably formed of flexible coilable steel, although other materials such as plastics may also be used. The frame member 32 should be made of a material which is relatively strong and yet is flexible to a sufficient degree to allow it to be coiled. Thus, the frame member 32 is capable of assuming two positions, an open or expanded position such as shown in FIG. 1, or a folded position in which the frame member 32 is collapsed into a size which is much smaller than its open position (see FIG. 5D). The frame member 32 may be merely retained within the frame retaining sleeve 30 without being connected thereto. Alternatively, the frame retaining sleeve 30 may be mechanically fastened, stitched, fused, or glued to the frame member 32 to retain the frame member 32 in position.

Fabric or sheet material 34 extends across the panel 22 and is held taut by the frame member 32 when the panel 22 is in its open position. The fabric 34 can extend tautly across the entire space defined by the frame member 32, or can extend across selected portions of the space defined by the frame member 32. The term fabric is to be given its broadest meaning and should be made from strong, lightweight materials and may include woven fabrics, sheet fabrics or even films. The type of fabric used will depend on the intended application. For example, a stronger and more durable fabric will be used if the object is intended for outdoor use, such as a road sign or flag, among others. In certain applications (such as when used as an umbrella shade), the fabric is preferably water-resistant and durable to withstand the wear and tear associated with rugged outdoor use or rough treatment by children and adults. Any pattern, message, color or indicia (see 40) can be provided on one or both sides of the fabric 34.

As illustrated best in FIG. 2, the frame retaining sleeve 30 may be attached to the fabric material 34 along the side edges 26*a*-26*d* of the panel 22. Specifically, the fabric material 34 can be attached to the frame retaining sleeve 30 by applying a stitching 38 that extends along the side edges 26*a*-26*d*. The stitching 38 can also operate to enclose the frame retaining sleeve 30. Alternatively, the frame retaining sleeve 30 can be a part of or an extension of the fabric material 34, where the side edge of the fabric material 34 is wrapped around the frame member 32 to enclose the frame member 32, and then the stitching 38 applied to enclose the sleeve 30.

An important benefit provided by the principles of the present invention is that these principles can be adapted to vary the usage and increase the applications available to existing or known devices. For example, the object 20 in FIG. 1 can be a flag or commercial sign post used by a retail store, with the bottom end 42 of the pole 24 secured to a bracket or holder 44 secured in a wall. Conventional flags are made of a fabric material, which causes the flag to wave as the wind blows, and often curl or wrap around the pole. To avoid this curling or wrapping problem, commercial signs are typically made of a heavy piece of wood or metal that can be expensive, and can cause damage or injury if the sign falls or breaks off from its pole or other support.

However, the panel 22 according to the present invention has a generally unchanged configuration when in its opened configuration, due to the support provided along its edges by the frame member 32. As indicated by the arrow 46 in FIG. 1, the panel 22 can be pivoted about its attachment mechanism (s) 25 (about an axis defined by the pole 24) so that wind or other forces will only cause the panel 22 to pivot about the pole 24. Therefore, when used as either a flag or a commercial sign, the panel 22 offers a novel and different type of "rigid" flag or exhibit medium that might have different appeal to consumers, since the panel 22 will not curl or wrap around the pole 22. This is a non-limiting example of the object 20 of the present invention having multiple uses (i.e., flag and commercial sign) where the conventional flags and sign posts would not have had the capability to be used as the other.

Figure 3A:
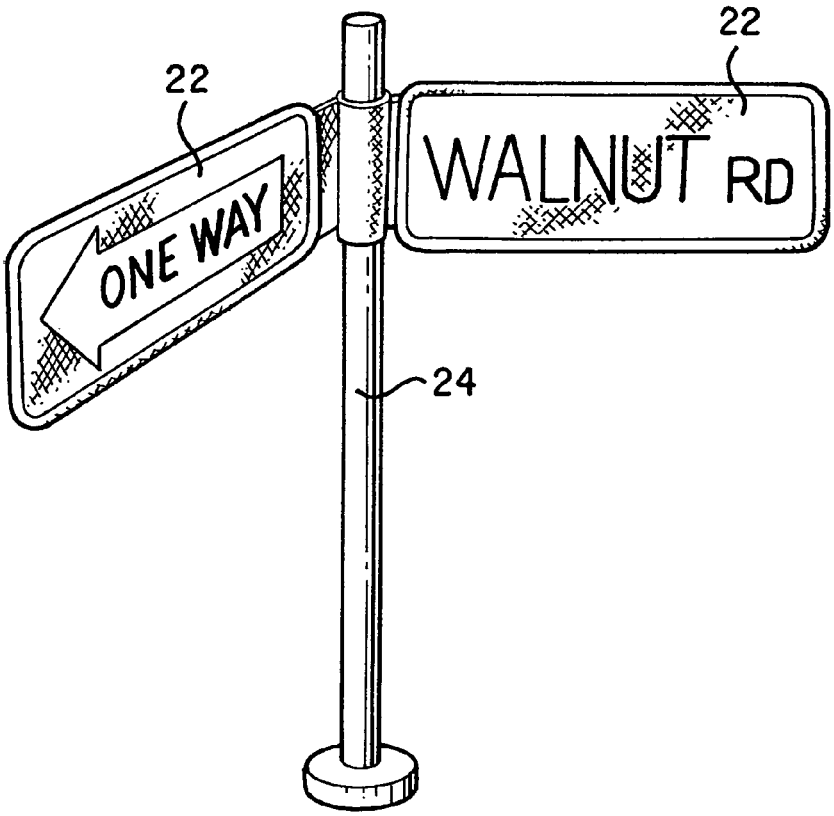
FIG. 3A illustrates the collapsible exhibit medium of FIG. 1A used as a road sign.

Alternatively, the panel 22 can be used as a road sign, as illustrated in FIG. 3. In this regard, the support provided along the edges of the panel 22 by the frame member 32 render the panel 22 sufficiently stiff (and non-curlable) in the open configuration, thereby making it well-suited for use as a road sign. In addition, as illustrated in FIG. 3, two or more panels 22 can be provided on the pole 24, each serving the same or different purpose (i.e., one identifies the name of a road, the other provides a warning such as "One Way"). The road sign can be used indoors (by children or adults for amusement purposes) or outdoors (as actual road signs).

Yet another possible application is that the panel 22 can be provided as a game background. For example, as shown in FIG. 1, openings 48 can be provided in the fabric 34, and the object 20 suspended from a wall or support like a flag, so that a user can toss a ball (not shown) through these openings 48.

When used as a road sign, game background, a flag or commercial sign, as described above, the panel 22 can be collapsed into a smaller configuration (as described in connection with FIGS. 5A-5D below), so that the panel 22 can be removed, collapsed and conveniently stored due to its smaller size. The ability to fold and collapse the panel 22 into a smaller size provides the users of flags, games, road signs and commercial signs with added convenience in storage and transportation, especially if the panel 22 is very large.

Figure 1B:
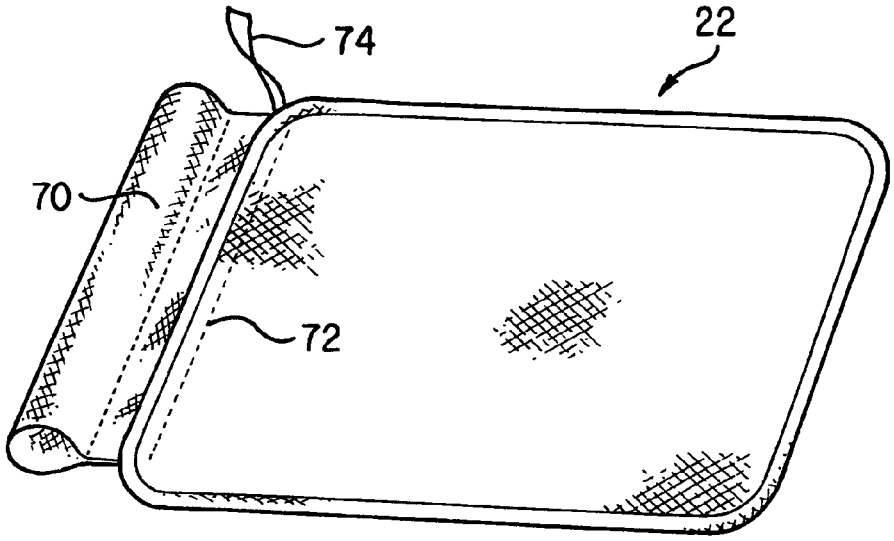
FIG. 1B illustrates how a sleeve is used to couple the panel to the pole in the embodiment of FIG. 1A.
Figure 3B:
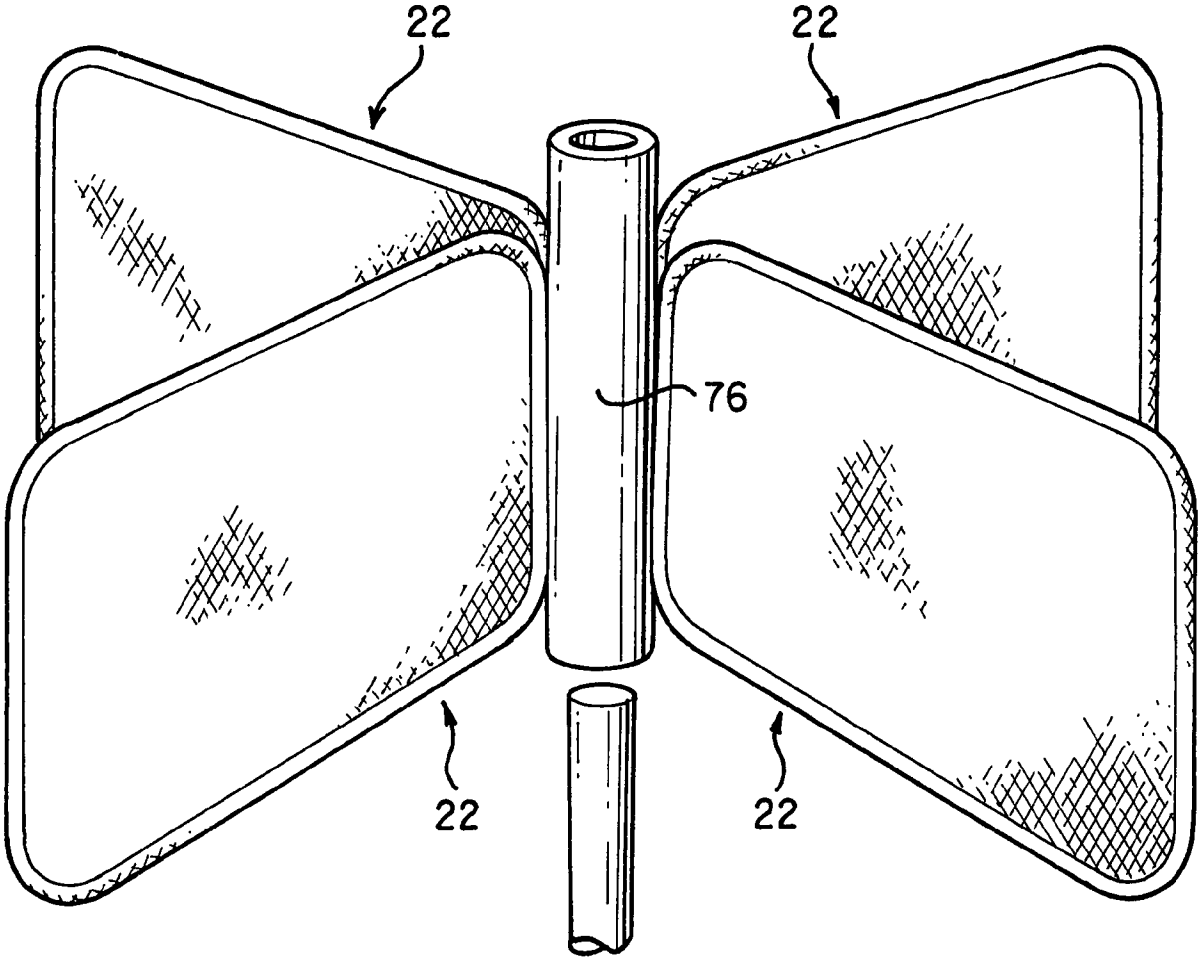
FIG. 3B illustrates a modification made to the embodiment of FIG. 3A.

FIG. 3B illustrates another non-limiting alternative, where a plurality (such as four) of panels 22 can be stitched or otherwise coupled to a central sleeve 76 that can be configured in the same manner as illustrated in FIG. 1B. Each of the plurality of panels 22 in FIG. 3B can be used for different purposes, such as an exhibit medium, a game background, etc.

Figure 4:
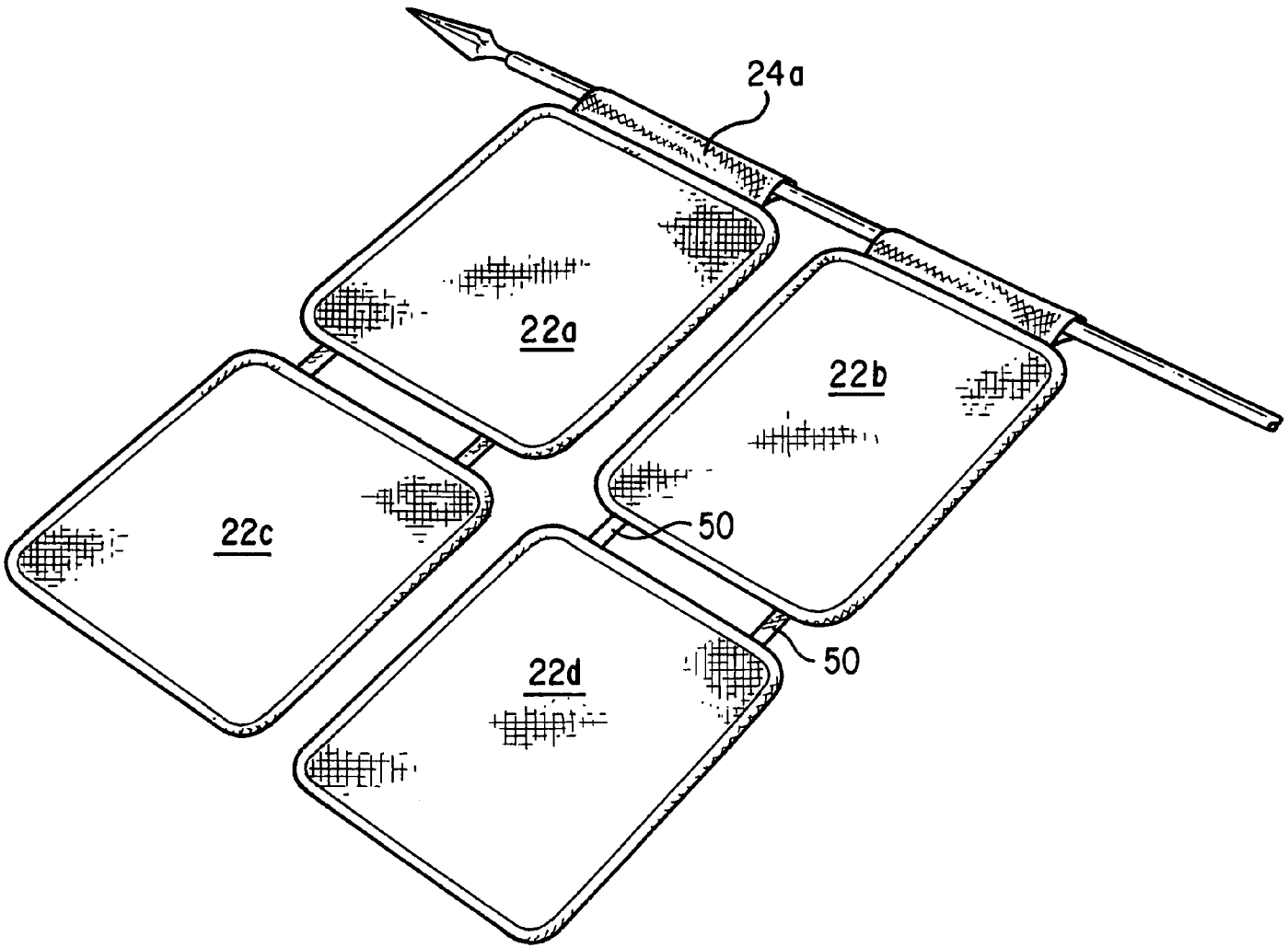
FIG. 4 illustrates another embodiment of a collapsible exhibit medium according to the present invention shown in use in its expanded configuration.

As yet another non-limiting alternative, FIG. 4 illustrates a plurality of panels 22*a*, 22*b*, 22*c*, 22*d* that can be attached to each other by any conventional attachment device 50, such as opposing Velcro™ pads, stitching, or straps, to define a larger area that may be used, for example, as an exhibit media to exhibit or display large drawings, signs, posters, messages, etc. The pole 24*a* can be stood vertically on a surface or ground (with the aid of a support such as a base), or can be hung or suspended from a wall or surface. Two of the panels 22*a*, 22*b* can be coupled to the pole 24*a* by any of the attachment mechanisms 25 described above. In addition, not all the panels 22*a*, 22*b*, 22*c*, 22*d* need to be attached to each other. For example, panel 22*c* can be attached to panel 22*a* but not to panel 22*d*. Similarly, panel 22*a* does not need to be attached to panel 22*b*. Thus, two of the panels (such as 22*a*, 22*c*) can together represent one media background, and the other two panels (22*b*, 22*d*) can together represent a separate media background, with both media backgrounds possibly allowing their respective images to be juxtaposed, combined, etc. In addition, the panels 22*a*-22*d* can have different shapes and sizes, with some coupled or uncoupled to others. As a non-limiting example, the panels 22*b* and 22*d* can be replaced by one larger panel that spans the space occupied by panels 22*b*, 22*d*, with the larger panel possibly coupled to, or detached from, the upper panels 22*a* and 22*c*.

Figure 5A:
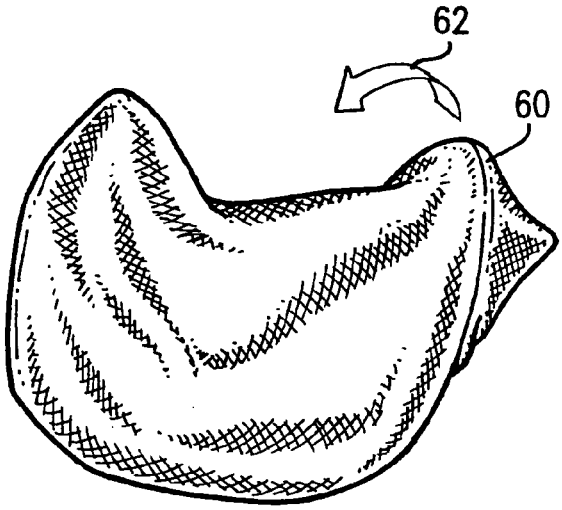
FIGS. 5A-5D illustrate how the collapsible exhibit medium of FIG. 1A can be folded and collapsed to reduce its overall size.
Figure 5B:
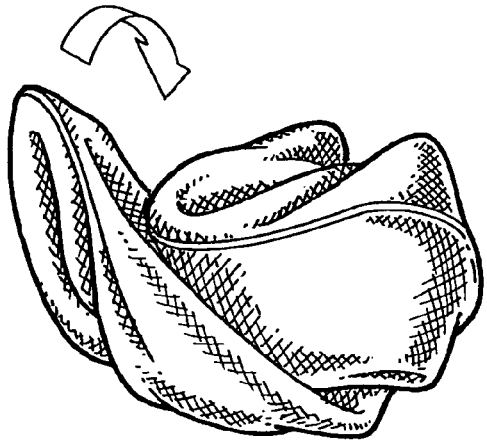
Figure 5C:
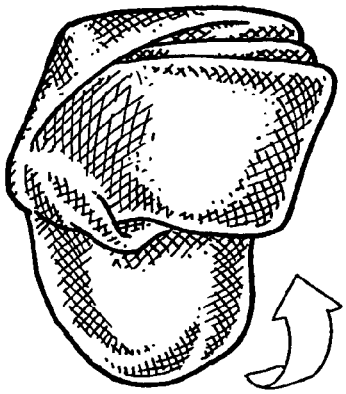
Figure 5D:
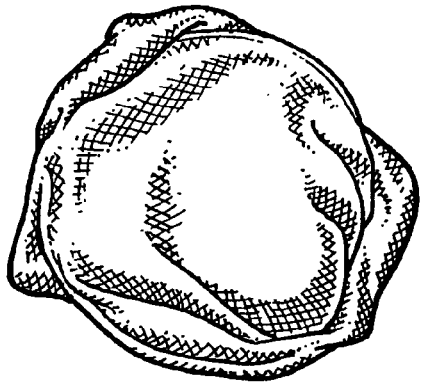

The object 20 can also be folded and collapsed into a compact configuration for storage, as illustrated in FIGS. 5A-5D. First, the panel 22 can be removed from the pole 24. Then, as shown in FIG. 5A, the opposite border 60 of the panel 22 is folded in (see arrow 62) to collapse the panels 22, 24. As shown in FIG. 5B, the collapsing is continued so that the initial size of the panel 22 is reduced. FIG. 5C shows the next step, in which the panel 22 is collapsed on itself to provide for a small essentially compact configuration having a plurality of concentric frame members 32 and layers of the fabric material 34 so that the collapsed panel 22 has a size which is a fraction of the size of the initial panel 22, as shown in FIG. 5D. Thus, the object 20 can be folded and stored very quickly using the steps illustrated in FIGS. 5A-5D.

To re-open the object 20 to its expanded configuration, the collapsed panel 22 is unfolded. The memory (i.e., spring-load) of the frame member 32 will cause the frame member 32 to uncoil on its own and quickly expand the panel 22 to the expanded or open configuration shown in FIG. 1. The panel 22 can then be coupled to the pole 24 for use.

The above-described methods for folding and collapsing a panel 22, and for re-opening the panel 22 to deploy the object 20 for use, can be applied to all the embodiments illustrated hereinbelow.

Figure 6:
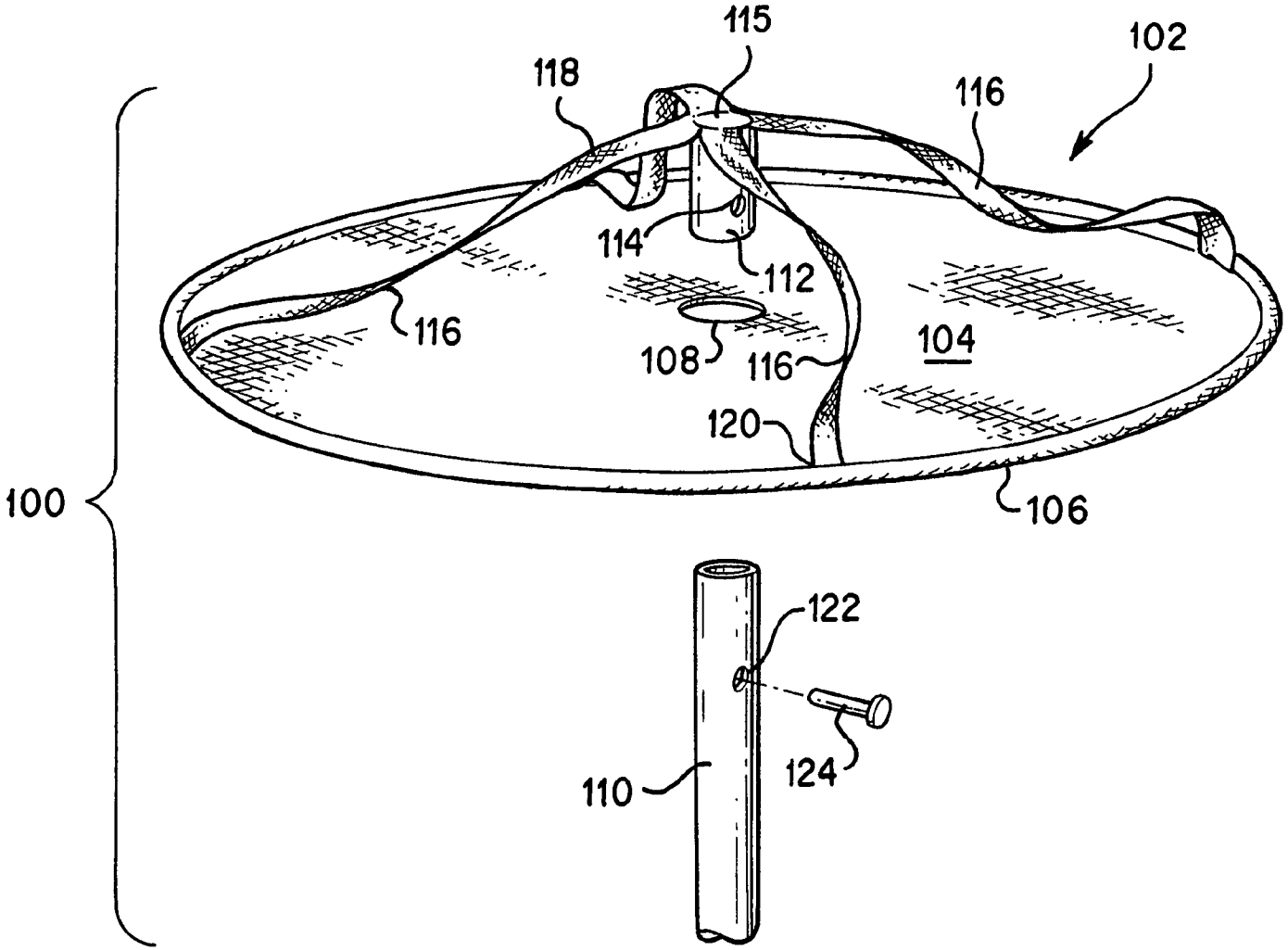
FIG. 6 is a perspective view of a collapsible umbrella according to one embodiment of the present invention shown in use in its expanded configuration.

FIG. 6 illustrates a collapsible umbrella 100 according to the present invention. The umbrella 100 has a panel 102 that can have essentially the same construction as panel 22 described above, except that the panel 102 can have a generally circular shape. As with panel 22, panel 102 has a surrounding frame member that supports fabric 104 in a taut manner when panel 102 is in the open position, as shown in FIG. 6, with the frame member retained inside a frame retaining sleeve 106. In addition, panel 102 has an opening 108 provided at about the center of panel 102 for allowing an umbrella shaft or pole 110 to be inserted therethrough.

A pole retaining sleeve 112 is provided above the panel 102 and aligned with the opening 108 for coupling thereto. The sleeve 112 is coupled to the panel 102 to retain and secure the pole 110 at a fixed position during use of the umbrella 100. The pole retaining sleeve 112 can be made from a fabric material (as defined above), and has an opening 114 extending therethrough. The top 115 of the sleeve 112 can be closed or sealed off. A plurality of radial upper straps or supports 116 are used to couple the pole retaining sleeve 112 to the panel 102. Any number of these radial upper supports 116 can be provided. Each support 116 has a first end 118 stitched or otherwise attached to the top of pole retaining sleeve 112, and a second end 120 stitched or otherwise attached to one location along the frame retaining sleeve 106 in a manner so that the respective second ends 120 are spaced apart from each other in a radial manner along the circumference of the frame retaining sleeve 106. In use, the pole 110 can be inserted through the opening 108 and into the pole retaining sleeve 112. The pole 110 has a through-hole 122 that is aligned with the opening 114 in sleeve 112 when the pole 110 is fitted inside the sleeve 112. A pin 124 is then inserted through the opening 114 and through-hole 122 above the panel 102 to secure the panel 102 at the top of the pole 110.

Thus, the panel 102 is used as an umbrella shade, to shield the user from sunlight or rainfall. The supports 116 function to support the circumferential edge of the panel 102, especially when heavy rainfall might cause the circumferential edge of the panel 102 to bend downwardly. When this happens, the supports 116 limit the extent to which the circumferential edge of the panel 102 can bend downwardly.

When the user wishes to store the umbrella 100, the pin 124 is removed, and the pole 110 removed from the sleeve 112. The panel 102 can then be folded and collapsed according to the steps illustrated in FIGS. 5A-5D to obtain a compact umbrella shade (i.e., the collapsed panel 102) that can be conveniently carried around or stored. To use the umbrella 100, the user opens the panel 102, and then inserts the pole 110 into the sleeve 112 and extends the pin 124 through the opening 114 and through-hole 122 above the panel 102 to secure the panel 102 at the top of the pole 110. The same principles for storing and deploying the umbrella 100 can be applied to the umbrellas described in the embodiments below.

Figure 7:
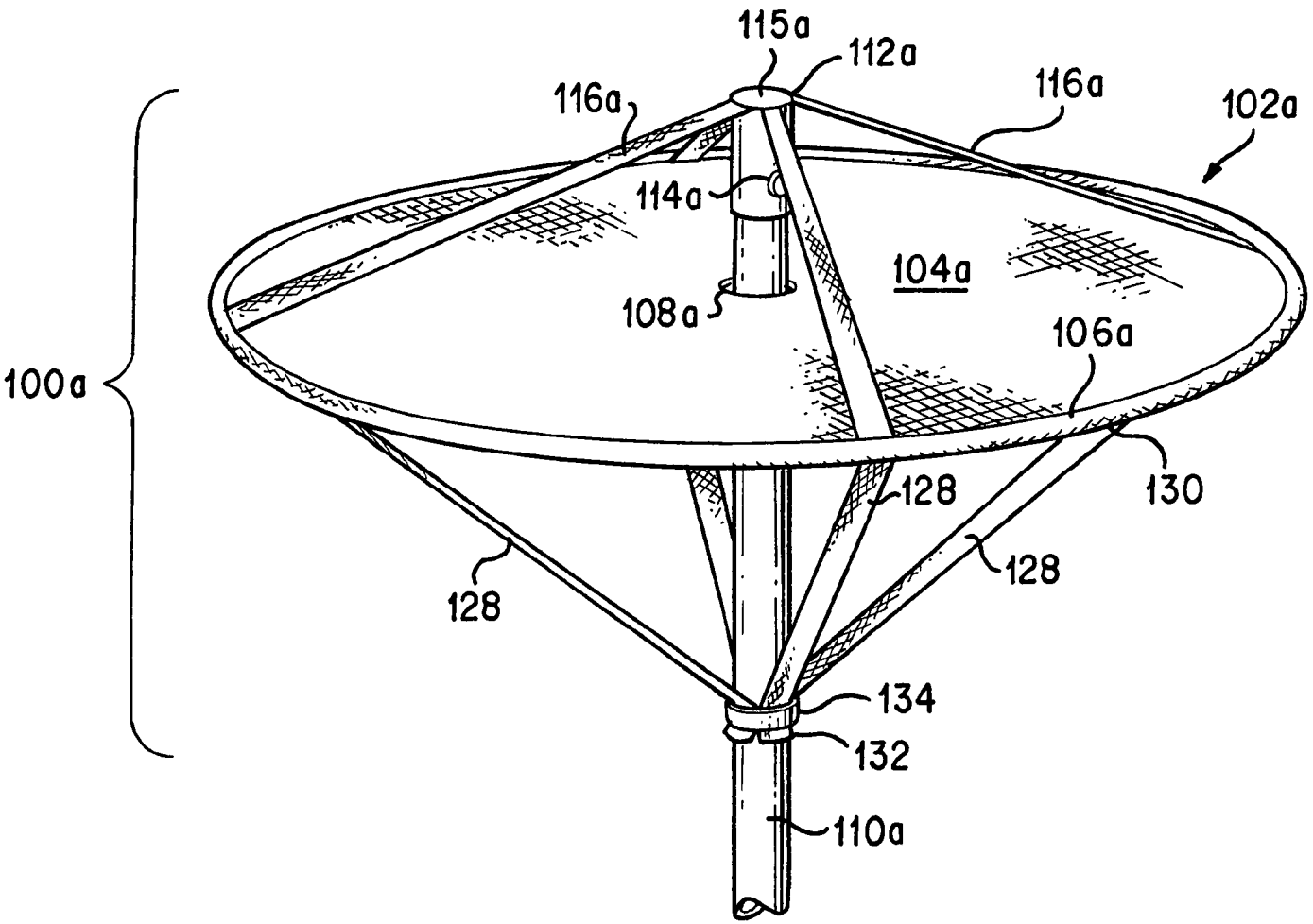
FIG. 7 illustrates modifications made to the umbrella of FIG. 6.

FIG. 7 illustrates modifications that can be made to umbrella 100 of FIG. 6. The umbrella 100*a* in FIG. 7 is essentially the same as umbrella 100, except that lower supports 128 are also provided to extend from the circumferential edge of the panel 102*a* to a point or location of the pole 110*a* below the panel 102*a*. Each lower support 128 has a first end 130 stitched or otherwise attached to one location along the frame retaining sleeve 106*a* in a manner so that the respective first ends 130 are spaced apart from each other in a radial manner along the circumference of the frame retaining sleeve 106*a*. An opposing second end 132 of each lower support 128 can be left free for the user to tie it to the pole 110*a*, or a coupling mechanism 134 (such as a hook, strap or other similar mechanism) can be provided at the second end 132 to enable the user to secure the second end 132 to the pole 110*a* during use. The lower supports 128 can be the same mechanism as the upper supports 116, and also functions to provide support to the panel 102*a* with respect to the pole 110*a*. When removing the pole 110*a*, the second ends 132 can be detached or untied from the pole 110*a*. The elements of the umbrella 100*a* that are the same as the elements of umbrella 100 are provided with the same numeral designations except that an "a" has been added to the numeral designations in FIG. 7, and shall not be described in greater detail herein.

Figure 8:
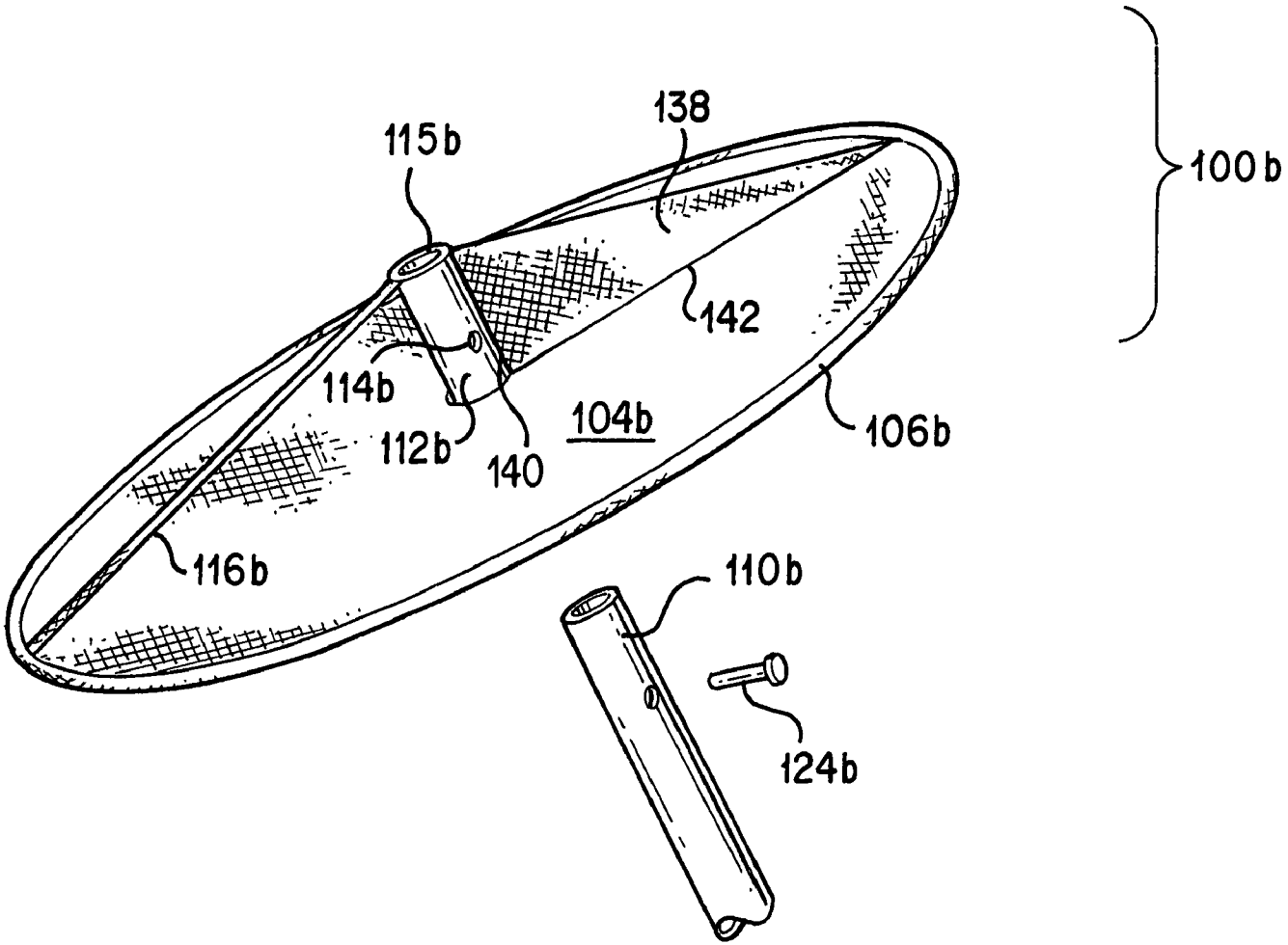
FIG. 8 illustrates modifications made to the umbrella of FIG. 6.

FIG. 8 illustrates additional modifications that can be made to umbrella 100 of FIG. 6. The umbrella 100*b* in FIG. 8 is essentially the same as umbrella 100, except that some of the upper supports are provided in the form of a thin strap or string (see 116*b*), while some of the upper supports are provided in the form of a fabric piece 138. The elements of the umbrella 100*b* that are the same as the elements of umbrella 100 are provided with the same numeral designations except that a "b" has been added to the numeral designations in FIG. 8. The fabric piece 138 preferably has a first (e.g., inner) edge 140 that is stitched or otherwise attached to the sleeve 112*b*, and a second (e.g., lower) edge 142 that is stitched or otherwise attached to the fabric 104*b*. In one embodiment, to achieve the greatest degree of support, the inner edge 140 can extend along the length of the sleeve 112*b*, and the lower edge 142 can extend along the radius of the panel 102*b* from the sleeve 112*b* to the frame retaining sleeve 106*b*. However, to achieve lesser degrees of support, the inner and lower edges 140, 142 can extend for shorter lengths along the sleeve 112*b* and fabric 104*b*, respectively.

Figure 9:
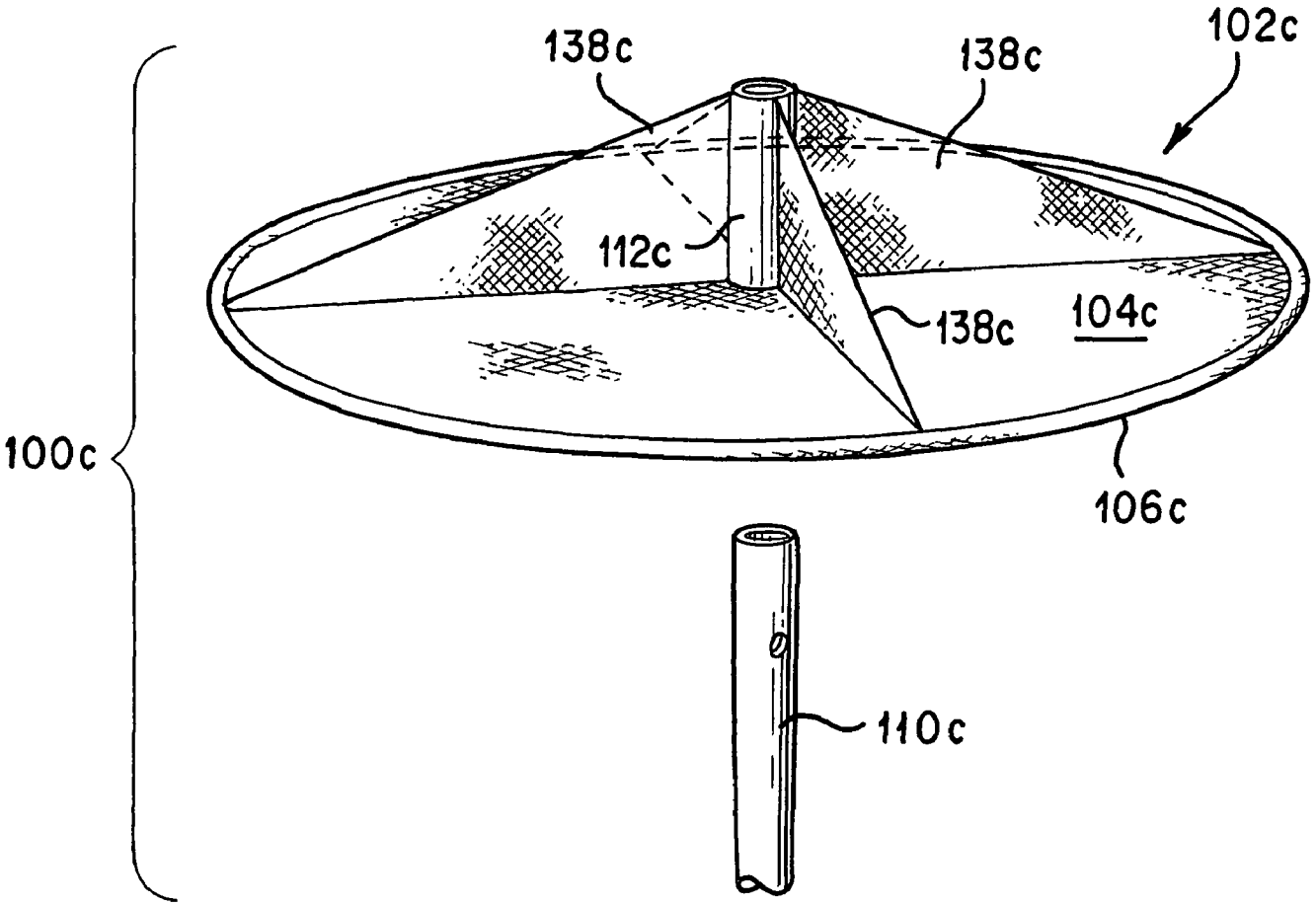
FIG. 9 illustrates modifications made to the umbrella of FIG. 8.

FIG. 9 illustrates an umbrella 100*c* that extends the principles illustrated by umbrella 100*b* of FIG. 8. The umbrella 100*c* in FIG. 9 is essentially the same as umbrella 100*b*, except that all of the upper supports are provided in the form of a fabric piece 138*c*, each of which is spaced apart along the frame retaining sleeve 106*c*. The elements of the umbrella 100*c* that are the same as the elements of umbrella 100*b* are provided with the same numeral designations except that a "c" has been added to the numeral designations in FIG. 9.

Figure 10:
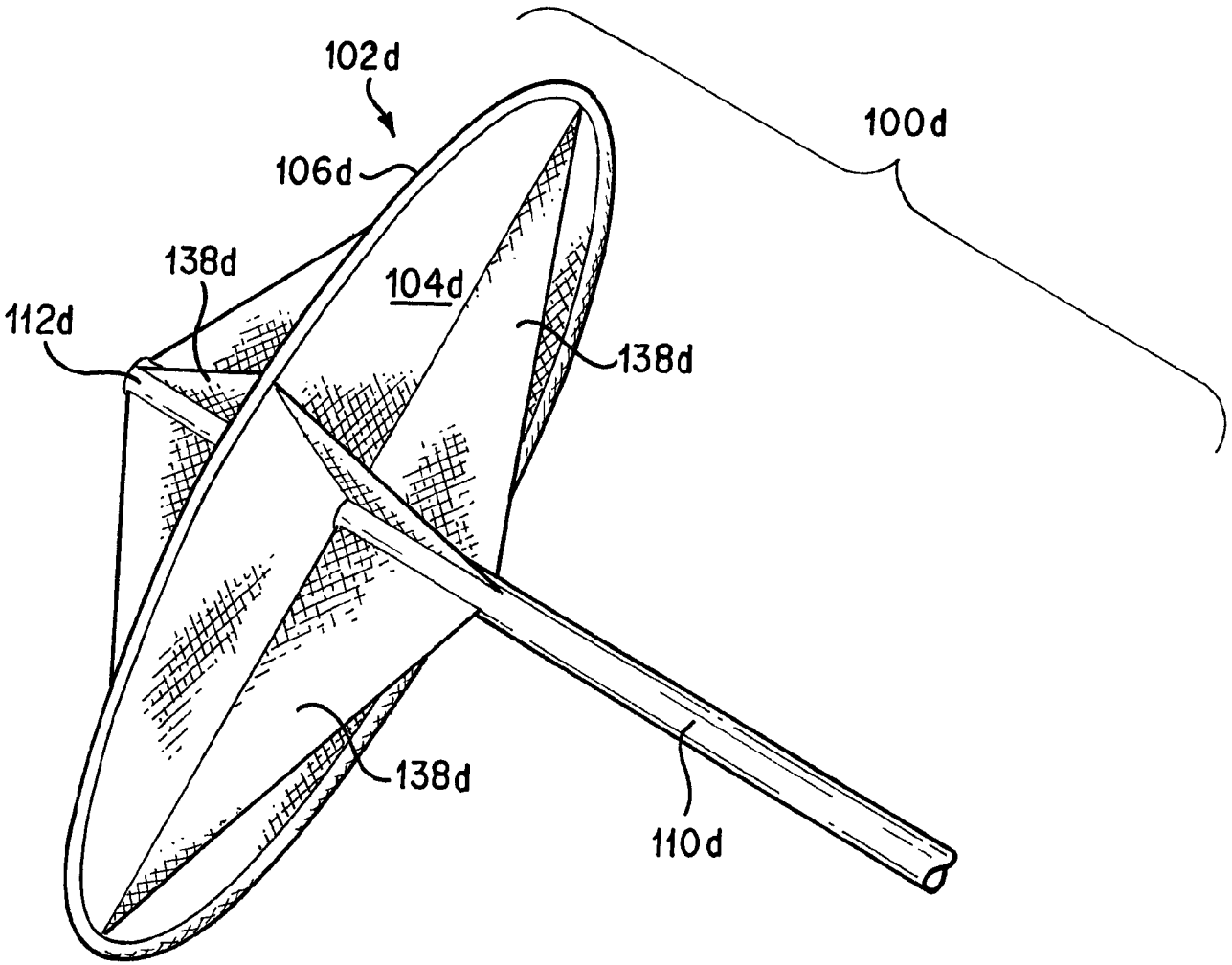
FIG. 10 illustrates modifications made to the umbrella of FIG. 9.

FIG. 10 illustrates an umbrella 100*d* that extends the principles illustrated by umbrellas 100*b* and 100*c* of FIGS. 8 and 9, respectively. The umbrella 100*d* in FIG. 10 is essentially the same as umbrellas 100*b* and 100*c*, except that all of the upper and lower supports are provided in the form of fabric pieces 138*d*, each of which is spaced apart along the frame retaining sleeve 106*d*. The elements of the umbrella 110*d* that are the same as the elements of umbrellas 100*b* and 100*c* are provided with the same numeral designations except that a "d" has been added to the numeral designations in FIG. 10.

Thus, the present invention provides collapsible objects that can be supported by a pole. These objects can include flags, commercial signs, road signs, games, exhibit medium and umbrellas, among others. By providing each of these objects with a collapsible panel, these objects can be collapsed and reduced in size for convenient storage and transportation, thereby enhancing the utility of these objects, and possibly increasing the types of uses for these objects. In addition, in certain circumstances (e.g., the games and flags illustrated above), variety in play and amusement value can also be increased.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface, the collapsible structure comprising:

a frame member having a folded and an unfolded orientation, and being within a horizontal plane generally parallel with the surface when the frame member is in the unfolded orientation, the frame member surrounding an interior space, with a fabric panel provided in the interior space and through which an opening is provided, wherein the frame member is collapsible to the folded position by twisting and folding to form a plurality of concentric rings;

a pole retaining fabric sleeve provided above the fabric panel and aligned with the opening, and coupled to the frame member via supports; and a pole having an upper end extending through the opening and into the pole retaining sleeve to support the frame member completely above the surface when the frame member is in the unfolded orientation.

2. The structure of claim 1, wherein the frame member is located within a fabric retaining sleeve.

3. The structure of claim 1, further including a pin that couples the upper end of the'pole to the pole retaining sleeve.

4. The structure of claim 1, wherein the supports comprise a plurality of straps that connect the pole retaining sleeve to the fabric panel.

5. The structure of claim 1, wherein the supports comprise a plurality of fabric pieces that are stitched to the pole retaining sleeve and the fabric panel.

6. The structure of claim 1, wherein the pole retaining sleeve has a closed upper end.

* * * * *